US007176772B2

(12) United States Patent
Maeda et al.

(10) Patent No.: US 7,176,772 B2
(45) Date of Patent: Feb. 13, 2007

(54) MULTILAYER COIL COMPONENT AND ITS MANUFACTURING METHOD

(75) Inventors: Eiichi Maeda, Shiga-ken (JP); Hiroshi Tanaka, Sagamihara (JP); Takahiro Yamamoto, Otsu (JP)

(73) Assignee: Murata Manufacturing Co. Ltd., Kyoto (JP)

( * ) Notice: Subject to any disclaimer, the term of this patent is extended or adjusted under 35 U.S.C. 154(b) by 0 days.

(21) Appl. No.: 10/531,956

(22) PCT Filed: Sep. 7, 2004

(86) PCT No.: PCT/JP2004/012987

§ 371 (c)(1),
(2), (4) Date: Apr. 19, 2005

(87) PCT Pub. No.: WO2005/036566

PCT Pub. Date: Apr. 21, 2005

(65) Prior Publication Data

US 2006/0049905 A1 Mar. 9, 2006

(30) Foreign Application Priority Data

Oct. 10, 2003 (JP) ..... 2003-352770

(51) Int. Cl.
*H01F 5/00* (2006.01)

(52) U.S. Cl. ..... 336/200

(58) Field of Classification Search ..... 336/65, 336/83, 200, 232
See application file for complete search history.

(56) References Cited

U.S. PATENT DOCUMENTS 6,218,925 B1 * 4/2001 Iwao ..... 336/200
6,630,881 B1 * 10/2003 Takeuchi et al. ..... 336/200
7,034,646 B2 * 4/2006 Yamamoto et al. ..... 336/200

FOREIGN PATENT DOCUMENTS

CN 1363938 A 8/2002
JP 2000-348939 12/2000
JP 2002-252117 9/2002
JP 2002-252117 A 9/2002

OTHER PUBLICATIONS

Official Communication issued in corresponding Chinese Patent Application No. 200480001080.7, dated Sep. 1, 2006.

* cited by examiner

*Primary Examiner*—Tuyen T Nguyen
(74) *Attorney, Agent, or Firm*—Keating & Bennett, LLP

(57) ABSTRACT

A laminated coil component includes a coil conductor including a plurality of strip electrodes and via-holes inside an approximately rectangular ceramic laminate. The via-holes connect the ends of the strip electrodes. The axis of the coil conductor corresponds with the width direction Z of the ceramic laminate that is substantially perpendicular to both the laminated direction (thickness direction) X and the longitudinal direction Y of the ceramic laminate. The manufacturing process includes the steps of laminating ceramic green sheets having the strip electrodes and/or the via-holes and the ceramic green sheets having printed conductive patterns constituting external electrodes, and press-bonding and firing them.

9 Claims, 7 Drawing Sheets

MULTILAYER COIL COMPONENT AND ITS MANUFACTURING METHOD

BACKGROUND OF THE INVENTION

1. Field of the Invention

The present invention relates to laminated coil components and methods of manufacturing the same. In particular, the present invention relates to a unique arrangement of coil conductors inside ceramic laminates.

2. Description of the Related Art

A longitudinally laminated and laterally coiled chip inductor disclosed in Japanese Unexamined Patent Application Publication No. 2002-252117 is an example of a laminated coil component. As shown in FIG. 11, a chip inductor 31 includes a coil conductor 33 having an axis that is perpendicular to the laminated direction (thickness direction) X inside an approximately rectangular ceramic laminate 32. The coil conductor 33 having the axis extending in the longitudinal direction Y of the ceramic laminate 32 is provided inside the ceramic laminate 32. Strip electrodes 34 are disposed at the upper portion and the lower portion inside the ceramic laminate 32. The ends of the strip electrodes 34 are connected with each other inside the ceramic laminate 32 through via-holes 35 passing through the ceramic laminate 32 in the thickness direction X to form the coil conductor 33.

The via-holes 35 are provided by forming through-holes at predetermined locations in each ceramic green sheet defining the ceramic laminate 32 and by filling the through-holes with a conductive material (conductive paste), such as an Ag paste. An example of the ceramic green sheet is a ferrite sheet. The two endmost strip electrodes 34 disposed at the upper portion of the ceramic laminate 32 extend to the side surfaces in the longitudinal direction Y of the ceramic laminate 32, and are connected to external electrodes 37 coated on the side surfaces of the ceramic laminate 32, respectively.

Regarding the preparation (not shown) of the ceramic laminate 32 of the chip inductor 31, a plurality of ceramic green sheets having only via-holes 35 are stacked in the laminated direction X. Then, a plurality of ceramic green sheets having strip electrodes 34 and via-holes 35 are attached on the top and the bottom of the resulting laminate of ceramic green sheets. Furthermore, a plurality of ceramic green sheets which do not have the strip electrodes 34 and the via-holes 35 are stacked on the top and the bottom of the resulting laminate of ceramic green sheets.

The ceramic laminate 32 is prepared by press-bonding the laminated ceramic green sheets monolithically along the laminated direction X, and by then firing. Then, the external electrodes 37 are formed on the side surfaces of the ceramic laminate 32 by dipping in a conductive paste and subsequent firing. Thus, the chip inductor 31 having the dipped end surfaces is prepared.

The relative inductance (L) of a coil in a laminated coil component will now be investigated. For example, in the known chip inductor 31, the coil conductor 33 has the highest relative inductance (L) when the inner cross-sectional area (inner area) and the outer cross-sectional area (outer area) of the coil conductor 33 are the same as each other. The highest relative inductance (L) is achieved when the laminated coil component is designed to have a ratio of approximately 1:1 regarding these areas.

In the design of the chip inductor 31, some restrictions must be taken into account. The ceramic green sheets stacked for defining outer coatings on the top position and the bottom position in the thickness direction X of the coil conductor 33 disposed inside the ceramic laminate 32 must have an outer-coating thickness that is greater than a predetermined thickness in order to prevent Ag diffusion. Side gaps in the width direction Z of the ceramic laminate 32 must be greater than a minimum gap required in order to prevent the exposure of the strip electrodes 34 and the via-holes 35 to the exterior regardless of distortion during laminating or cutting.

These restrictions are more noticeable as the outside dimension of the chip inductor 31 decreases. As a result, it is highly disadvantageous to design a coil conductor 33 having substantially equal inner and outer areas.

The ceramic laminate 32 of the chip inductor 31 is prepared by press-bonding a large number of ceramic green sheets, and by firing them after cutting. In general, the conductive material in the through-holes defining the via-holes 35 are not readily deformed during the press-bonding as compared to the ceramic green sheets. Therefore, the conductive material functions as posts for resisting the compacting pressure during the press-bonding, and the via-holes 35 receive the compacting pressure.

Consequently, the compacting pressure applied to ceramic regions near the via-holes 35 which are densely arranged is less than that applied to ceramic regions that are spaced from the via-holes 35. Because of low compacting pressure, delamination and insufficient sintering during firing readily occur at the ceramic regions near the via-holes 35. Furthermore, the conductive Ag material for the via-holes 35 is easily diffused, which results in a decrease in insulating resistance between the via-holes 35.

SUMMARY OF THE INVENTION

To overcome the problems described above, preferred embodiments of the present invention achieve a high relative inductance (L) by equalizing the inner area and the outer area of a coil conductor, while a reduced size and a thin shape are maintained. Furthermore, preferred embodiments of the present invention provide a laminated coil component which effectively prevents a decrease in insulating resistance between via-holes and also provide a method for manufacturing the same.

A laminated coil component according to a preferred embodiment of the present invention includes a coil conductor including a plurality of strip electrodes and via-holes for connecting predetermined ends of the strip electrodes inside an approximately rectangular ceramic laminate. The axis of the coil conductor corresponds to the width direction of the ceramic laminate, which is substantially perpendicular to both the laminated direction (thickness direction) and the longitudinal direction of the ceramic laminate. The axis of the coil conductor is substantially perpendicular to the laminated direction (thickness direction) of the ceramic laminate and also substantially perpendicular to the longitudinal direction of the ceramic laminate.

In the laminated coil component according to this preferred embodiment, external electrodes are preferably disposed at end regions in the longitudinal direction on a main surface in the laminated direction of the ceramic laminate and are connected to the ends of the coil conductor.

The external electrodes preferably cover the regions where the via-holes are arranged.

A method for manufacturing the laminated coil component according to another preferred embodiment of the present invention includes the steps of laminating ceramic green sheets having the strip electrodes and/or the via-holes and ceramic green sheets having printed conductive patterns defining the external electrodes, and press-bonding and firing the laminated ceramic green sheets.

In a laminated coil component having a built-in coil conductor, in order to achieve a reduction in size and thickness, particularly, in order to achieve a low profile, the thickness of the laminated coil component is less than its length and width. In such a construction, the inner area of the coil conductor is substantially less than the outer area when the axis of the coil conductor corresponds with the longitudinal direction of a ceramic laminate.

The reduction in size and thickness of a laminated coil component according to preferred embodiments of the present invention is achieved by utilizing general characteristics of the laminated coil component. The laminated coil component according to preferred embodiments of the present invention achieves a high relative inductance (L) even if an outer-coating thickness and side gaps are minimized. Accordingly, the bias characteristics are improved and the manufacturing costs are decreased because the number of the via-holes is reduced as compared to that of a known component.

In the laminated coil component described in the preferred embodiments described above, the axis of the coil conductor corresponds with the width direction of the ceramic laminate, which is substantially perpendicular to both the laminated direction (thickness direction) and longitudinal direction of the ceramic laminate. Therefore, the inner area of the coil conductor is prevented from being substantially less than the outer area, and the relative inductance (L) of the coil conductor is increased by the substantially equal sizes of these areas. Accordingly, the bias characteristics are improved and the manufacturing costs are decreased because the number of the via-holes is reduced as compared to that of a known component.

In the laminated coil component according to the preferred embodiments described above, the external electrodes are preferably disposed at end regions in the longitudinal direction on a main surface in the laminated direction of the ceramic laminate and are connected to the ends of the coil conductor. In other words, in this laminated coil component, the external electrodes are preferably disposed on a main surface in the thickness direction, not on the side surfaces in the longitudinal direction of the ceramic laminate.

In general, the external electrodes of a known laminated coil component are formed by dipping the side surfaces of the ceramic laminate. The external electrodes are not been disposed on a main surface of the ceramic laminate. In the laminated coil component according to preferred embodiments of the present invention, since the external electrodes are preferably disposed on a main surface of the ceramic laminate, a process for mounting the laminated coil component on a substrate, i.e. a process for connecting the external electrodes of the laminated coil component to wiring patterns on a substrate, is easily performed.

For example, the external electrodes of the laminated coil component and the wiring patterns on the substrate can be easily connected to each other by wire-bonding or with a bump disposed between each external electrode of the laminated coil component and each wiring pattern on the substrate. Preferably, the external electrodes are arranged so as to be spaced from the edge of a main surface of the ceramic laminate in order to avoid chipping or delamination during barreling. In such a structure, the stray capacitance is less than that of the known product having dipped end surfaces.

In the laminated coil component according to the preferred embodiments of the present invention described above, since the external electrodes are arranged so as to cover the regions where the via-holes are arranged, the compacting pressure during the press-bonding of the ceramic laminate acts not only on the via-holes but also on the ceramic regions near the via-holes through the external electrodes. Therefore, the ceramic regions near the via-holes are also pressed with a compacting pressure that is substantially equal to that at the ceramic regions spaced away from the via-holes.

Therefore, the occurrence of delamination and insufficient sintering during firing is prevented at the ceramic regions near the via-holes. As a result, Ag diffusion to the ceramic region and a decrease in insulating resistance between the via-holes are effectively prevented.

When a mold is used for press-bonding, the surface of the external electrode disposed on a main surface of the ceramic laminate may be flat. As a result, for example, a bonding strength for binding a bonding wire to the external electrode is advantageously improved as compared to that in the known external electrode formed by dipping.

In the process for manufacturing the laminated coil component according to the preferred embodiments of the present invention described above, ceramic green sheets having the strip electrodes and/or the via-holes and ceramic green sheets having printed conductive patterns defining the external electrodes are laminated, and then press-bonding and firing are performed. In such a process, the laminated coil component is easily manufactured.

In such a manufacturing process, after connecting the external electrodes to the coil conductor through the via-holes, the conductive patterns for the external electrodes can also be fired in a process for firing the ceramic laminate. Therefore, in order to form the external electrodes, the coating and firing processes for the conductive paste alone are unnecessary. Therefore, the processing costs are reduced.

Other features, elements, steps, characteristics and advantages of the present invention will become more apparent from the following detailed description of preferred embodiments thereof with reference to the attached drawings.

DETAILED DESCRIPTION OF PREFERRED EMBODIMENTS

First Preferred Embodiment

Figure 1:
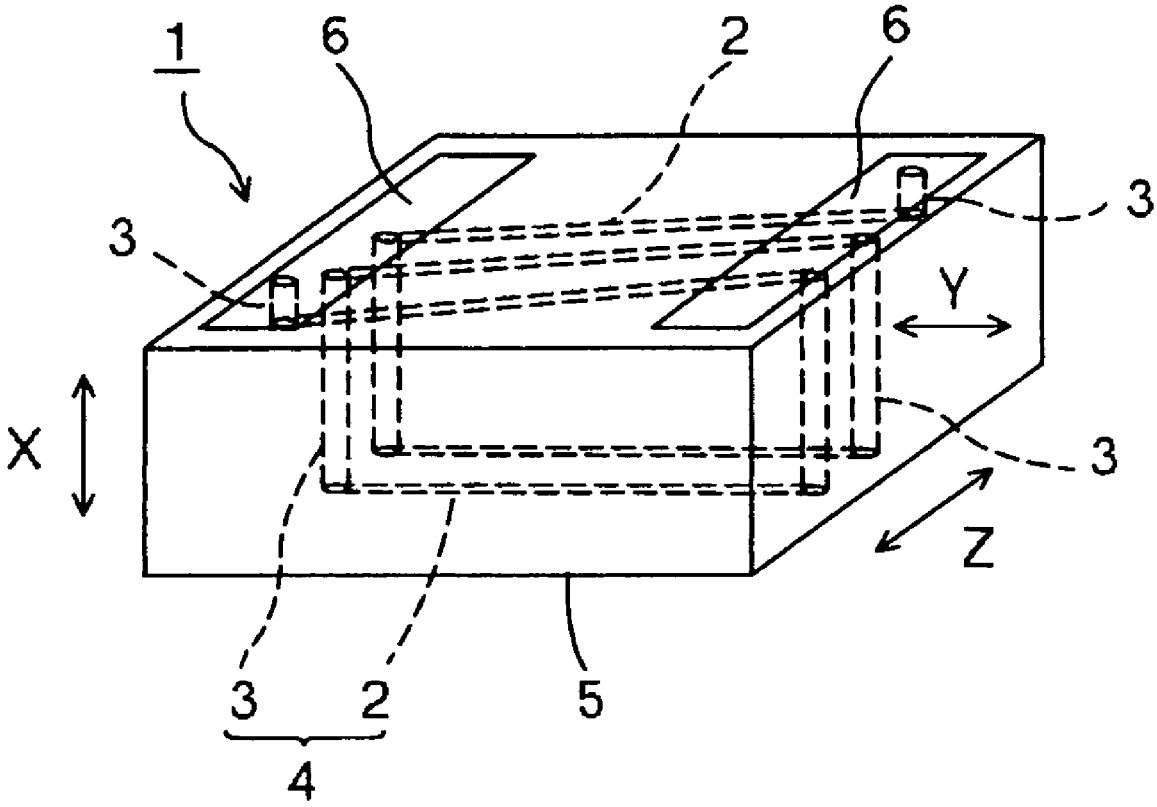
FIG. 1 is a perspective view of a chip inductor of a laminated coil component according to a first preferred embodiment of the present invention.
Figure 2:
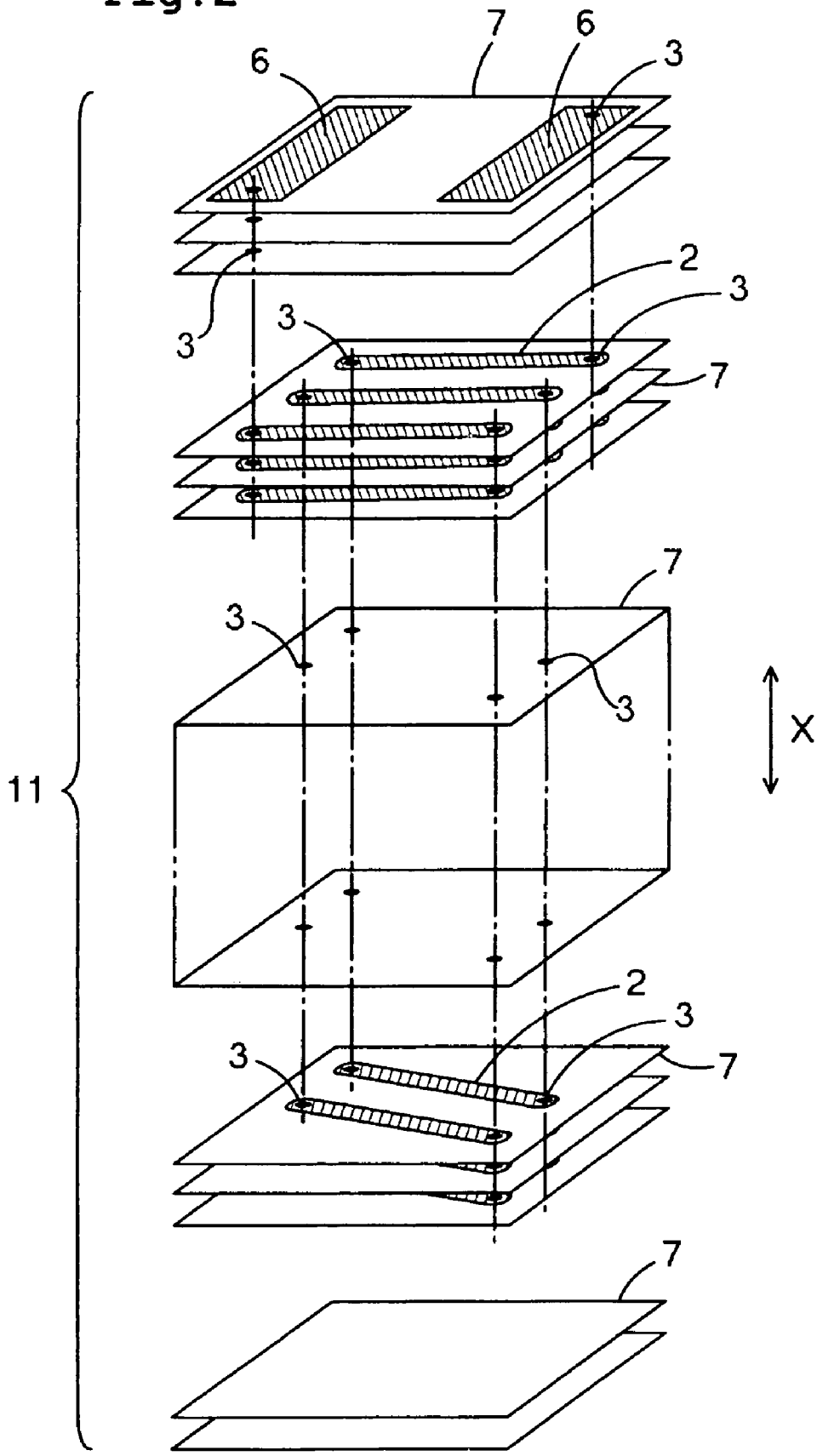
FIG. 2 is an exploded perspective view of the chip inductor.
Figure 3:
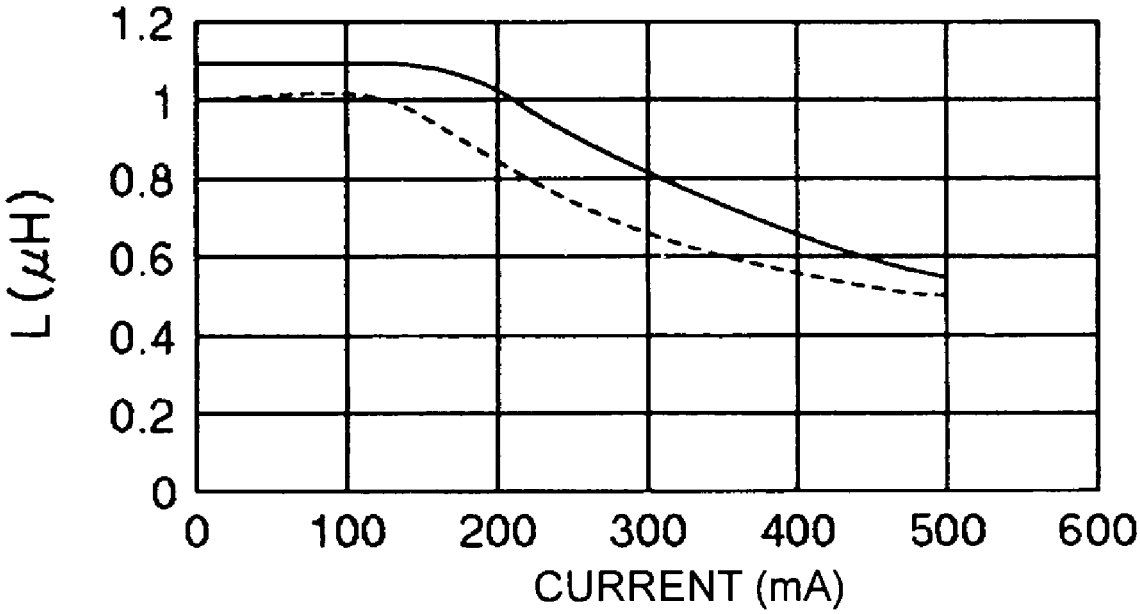
FIG. 3 is a graph showing relationships between inductance (L) characteristics and applied current.
Figure 4:
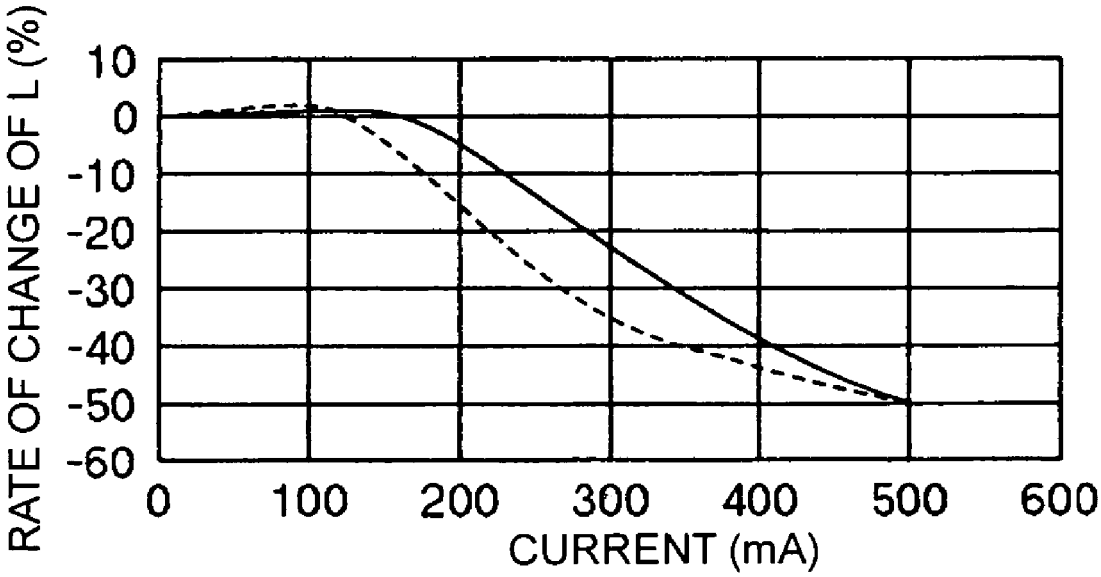
FIG. 4 is a graph showing rates of change of inductance (L) with applied current.
Figure 5:
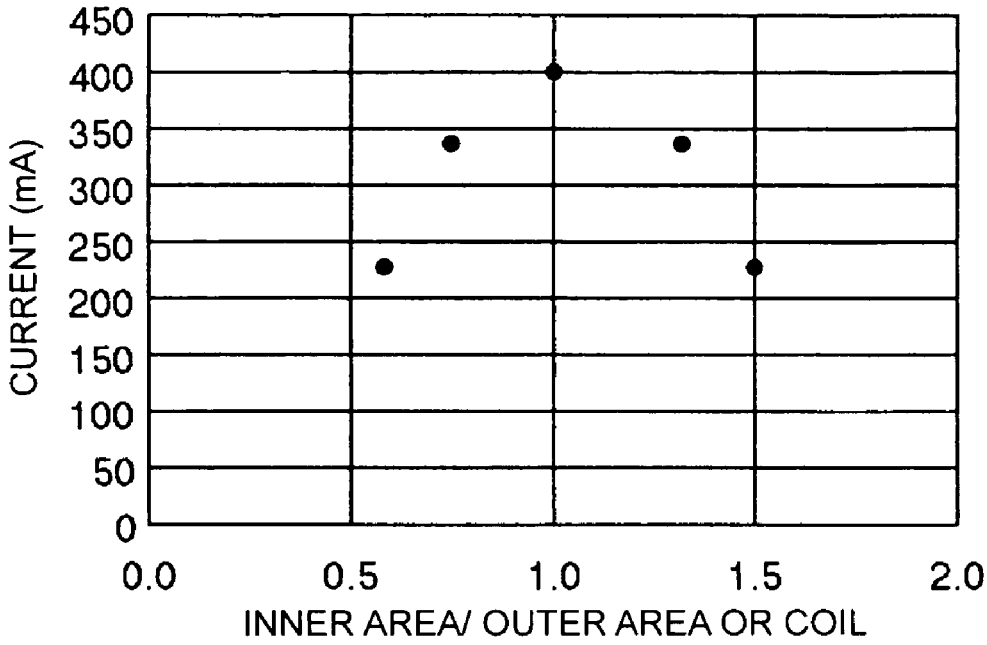
FIG. 5 shows a relationship between a ratio of the areas of a coil conductor and bias characteristics.
Figure 6:
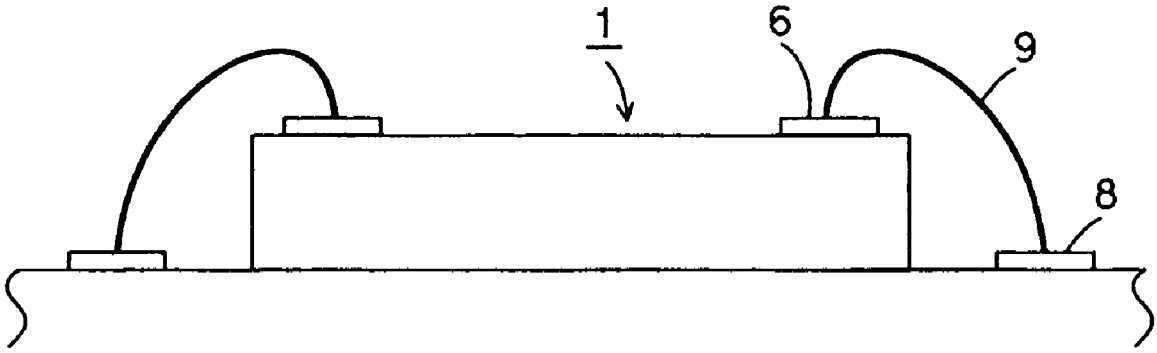
FIG. 6 is a side view of a first mounting structure of the chip inductor.
Figure 7:
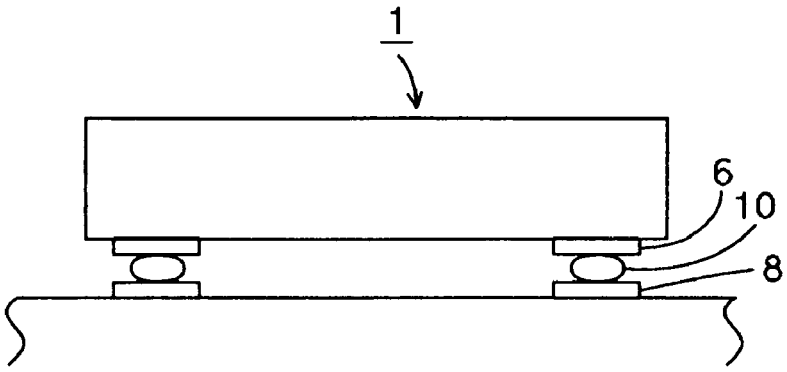
FIG. 7 is a side view of a second mounting structure of the chip inductor.
Figure 8:
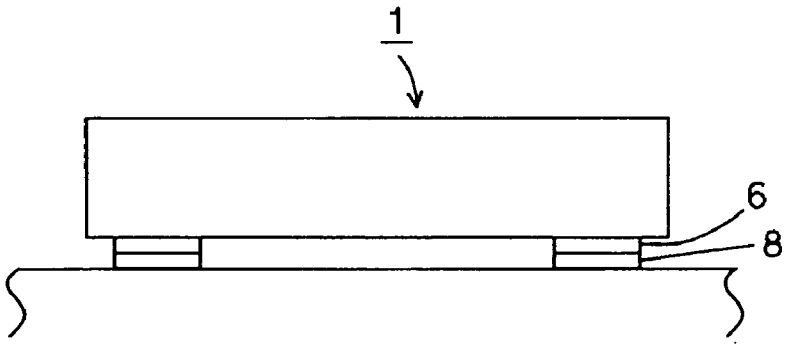
FIG. 8 is a side view of a third mounting structure of the chip inductor.

FIG. 1 is a perspective view of a chip inductor of a laminated coil component according to a first preferred embodiment. FIG. 2 is an exploded perspective view of the chip inductor. FIG. 3 is a graph showing characteristics of relative inductance (L) with an applied current. FIG. 4 is a graph showing a rate of change in relative inductance (L) with an applied current. FIG. 5 shows a relationship between a ratio of the areas and bias characteristics in a coil conductor. FIGS. 6 to 8 are side views of mounted chip inductors; FIG. 6 shows a first mounting structure, FIG. 7 shows a second mounting structure, and FIG. 8 shows a third mounting structure.

Referring to FIGS. 1 and 2, the chip inductor 1 preferably includes a coil conductor 4 including a plurality of strip electrodes 2 and a large number of via-holes 3 inside an approximately rectangular ceramic laminate 5. The via-holes 3 electrically and mechanically connect predetermined ends of the strip electrodes 2. In the chip inductor 1, the strip electrodes 2 are disposed at predetermined intervals at the upper portion and the lower portion in the laminated direction (thickness direction) X of the ceramic laminate 5, and the ends of the strip electrodes 2 are connected with the via-holes 3 passing through the ceramic laminate 5 in the thickness direction X such that the coil conductor 4 is spiral-shaped.

In this structure, the axis of the coil conductor 4 corresponds with the width direction Z of the ceramic laminate 5 that is substantially perpendicular to both the laminated direction (thickness direction) X and the longitudinal direction Y of the ceramic laminate 5. The direction of the axis of the coil conductor 4 is substantially perpendicular to the laminated direction X of the ceramic laminate 5 and also substantially perpendicular to the longitudinal direction of the ceramic laminate 5. One of the ends of each strip electrodes 2 aligned at the endmost positions in the width direction Z at the upper position of the ceramic laminate 5 is connected to the via-hole 3 passing through the ceramic laminate 5 in the thickness direction X and extending to the upper main surface in the thickness direction X of the ceramic laminate 5.

Exposed external electrodes 6 are disposed on end positions in the longitudinal direction Y of the upper main surface in the thickness direction X of the ceramic laminate 5. The via-holes 3 extend to the upper main surface of the ceramic laminate 5 and are electrically connected to the respective external electrodes 6. In the chip inductor 1, each of the external electrodes 6 is disposed on the top surface in the laminated direction X of the ceramic laminate 5 to cover the region where the via-holes 3 are aligned.

The strip electrodes, and the external electrodes 6 are formed on surfaces of ceramic green sheets 7 defining the ceramic laminate 5 with a conductive material (conductive paste), such as an Ag paste. In FIG. 2, three-layer strip electrodes 2 are preferably provided. However, one-layer strip electrodes 2 may be provided. The via-holes 3 are formed, for example, by irradiating each of the ceramic green sheets 7 with a laser beam to provide through-holes at predetermined locations of the ceramic green sheets 7, and then by filling the through-holes with a conductive material, such as an Ag paste.

In this preferred embodiment, the external electrodes 6 are each aligned at inner locations that are spaced from the edge of a main surface of the ceramic laminate 5. In this state, the external electrodes 6 are not chipped or delaminated during a barreling process. However, the present invention is not limited to such a configuration. The external electrode 6 may extend to the edge of the main surface of the ceramic laminate 5 (not shown).

In the chip inductor 1, the axis of the coil conductor 4 corresponds with the width direction Z of the ceramic laminate 5 that is substantially perpendicular to both the laminated direction (thickness direction) X and the longitudinal direction Y of the ceramic laminate 5. The fired chip inductor 1 preferably has a thickness of about 0.35 mm, a width of about 3.2 mm, an outer-coating thickness of about 0.04 mm, and side gaps of about 0.1 mm, for example. In such a chip inductor 1, the inner area and the outer area of the coil conductor 4 are preferably substantially the same, i.e. it was observed by the inventors of the present invention that the ratio of these areas is approximately 1:1.4 and the relative inductance (L) of the coil conductor 4 is approximately 1.1 μH, for example.

On the other hand, in a known chip inductor 31, for example, when the fired chip inductor has a thickness of about 0.35 mm, a width of about 1.6 mm, an outer-coating thickness of about 0.04 mm, and side gaps of about 0.1 mm, the ratio of the inner area and the outer area of the coil conductor 33 is approximately 1:1.8. Therefore, the relative inductance (L) of the coil conductor 33 is only about 1.0 μH. It is also observed that the relative inductance (L) of the inventive chip inductor 1 is greater than that of the known chip inductor 31.

The results observed by the inventors on the measurement of inductance (L) characteristics and the rate of change of inductance (L) as a current is applied are shown in FIGS. 3 and 4. In FIGS. 3 and 4, the solid lines represent the results in the inventive chip inductor 1 and the broken lines represent the results in the known chip inductor 31. As shown in FIGS. 3 and 4, the inventive structure is superior to the known structure in both the inductance (L) characteristics and the rate of change of inductance (L).

FIG. 5 shows a relationship between the ratio of the areas and the bias characteristics of the coil conductor 4 at a current level when the inductance decreases by about 30%. According to the observed results, when the ratio of the inner area and the outer area of the coil conductor 4 is approximately 1:1, the upper limit of an allowable current level is greater than that of a coil conductor having a ratio of the areas that is substantially different from 1:1. Therefore, a high inductance is maintained even if a large amount of current is biased. As a result, in the chip inductor 1 having the structure according to the first preferred embodiment, the bias characteristics are improved while a high relative inductance (L) is maintained, even when the outer-coating thickness and side gaps are minimized.

Furthermore, in the chip inductor 1, the external electrodes 6 are disposed on a main surface of the ceramic laminate 5 and cover the regions where the via-holes 3 are disposed in the ceramic laminate 5. Therefore, during the press-bonding of the ceramic laminate 5, a compacting pressure for the press-bonding acts not only on the via-holes 3 but also on ceramic regions near the via-holes 3 through the external electrodes. As a result, the ceramic regions in the vicinity of the via-holes 3 are sufficiently press-bonded and the occurrence of delamination and insufficient sintering during firing of the ceramic laminate 5 is prevented.

The inventors of the present invention investigated the relationship between a thickness of the external electrodes 6 disposed on a main surface of the ceramic laminate 5 and the rate of delamination. The rate of delamination was about 15% when the external electrodes 6 are not formed on the main surface of the ceramic laminate 5.

On the other hand, when the external electrodes 6 are formed by printing to have a thickness of about 5 μm so as to have a thickness of about 3 μm after the press-bonding, the rate of delamination was about 10%. When the external electrodes 6 are formed by printing to have a thickness of about 15 μm so as to have thickness of about 10 μm after the press-bonding, the rate of delamination was 0%. It was observed that the rate of delamination is significantly improved by the presence of the external electrodes 6. In particular, it is preferable that the external electrodes 6 be printed to have a thickness of at least about 15 μm.

If delamination and insufficient sintering during firing of the ceramic laminate 5 is prevented, Ag diffusion to the ceramic regions among the via-holes 3 and a decrease in insulating resistance between the via-holes are efficiently prevented. When the ceramic laminate 5 is press-bonded with a mold (not shown), external electrodes 6 having flat surfaces are formed. As a result, for example, the bonding strength between a bonding wire and the external electrode 6 is advantageously improved.

The inventors of the present invention compared the bonding strength of the external electrodes 6 plated with Ni (base) and Au on the main surface of the ceramic laminate 5 in the chip inductor 1 with the bonding strength of the external electrodes 37 plated with Ni (base) and Au on the side surfaces of the ceramic laminate 32 by dipping and firing in the known chip inductor 31. More specifically, Au-wire bonding in these chip inductors was evaluated by a ball shear test and a wire pull test. The results of these tests showed that the chip inductor 1, i.e. the structure having the external electrodes 6 plated with Ni (base) and Au on the main surface of the ceramic laminate 5, has a bonding strength that is greater than that of the known chip inductor.

When the external electrodes 6 are disposed at regions near the edges in the longitudinal direction Y of the upper main surface in the thickness direction X of the ceramic laminate 5 in the chip inductor 1, various structures for mounting the chip inductor 1 can be used as described below. In a first mounting structure shown in FIG. 6, each of the external electrodes 6 of the chip inductor 1 and a wiring pattern 8 on a substrate on which the chip inductor 1 is mounted are easily bonded by wire bonding with an Au wire 9 or other suitable wire.

In a second mounting structure shown in FIG. 7, solder balls or Au balls 10 may be used for bonding. In this case, the solder balls or Au balls 10 are provided on the external electrodes 6 of the chip inductor 1, and are then bonded to the external electrodes 6 by reflowing or an ultrasonic treatment. Then, the chip inductor 1 is turned upside down and each of the solder balls or Au balls 10 is bonded to a wiring pattern 8 on a substrate by reflowing or other suitable method.

In a third mounting structure shown in FIG. 8, each of the Au-plated external electrodes 6 of the chip inductor 1 and a wiring pattern 8 on a substrate may be directly connected, and then bonded by an ultrasonic treatment. Each of the external electrodes 6 of the chip inductor 1 and the wiring pattern 8 on the substrate on which the chip inductor 1 is mounted can be bonded with a conductive adhesive or anisotropic conductive tape (not shown). In such a mounting structure, since a high temperature for soldering is not applied to the chip inductor 1, the chip inductor 1 does not undergo a change in its characteristics.

A method for manufacturing the chip inductor 1 will now be described with reference to FIG. 2. A water-based binder (vinyl acetate, water-soluble acrylic resin, etc.) or an organic binder (polyvinyl butyral, etc.) is added to a magnetic material, i.e. Ni—Cu—Zn ferrite. After the addition of a dispersant and antifoam, ceramic green sheets 7 are formed by doctor blading or with a reverse-roll coater. A predetermined number of the ceramic green sheets 7 are irradiated with a laser beam at predetermined positions of each ceramic green sheet 7 to form the through-holes for the via-holes 3.

The via-holes 3 are formed by filling the through-holes formed in the ceramic green sheets 7 with an Ag paste by screen-printing. The strip electrodes 2 defining portions of the coil conductor 4 are formed at predetermined locations of the surface of each ceramic green sheet 7 by screen-printing an Ag paste. Conductive patterns defining the external electrodes 6 are formed at predetermined locations on the surfaces of other ceramic green sheets 7.

A predetermined number of the ceramic green sheets 7 having only the via-holes 3 are stacked in the laminated direction X. Then, a predetermined number of the ceramic green sheets 7 having the strip electrodes 2 and the via-holes 3 are stacked on the top and the bottom of the resulting laminate of ceramic green sheets 7. Furthermore, the ceramic green sheets 7 having the conductive patterns defining the external electrodes 6 are stacked on the top of the resulting laminate of ceramic green sheets 7. The ceramic green sheets 7 without any of the strip electrodes 2, the via-holes 3, and the conductive patterns defining the external electrodes 6 are also stacked on the bottom of the resulting laminate of ceramic green sheets 7.

A sheet laminate 11 formed in such a process is press-bonded in the laminated direction X, and then cut to a predetermined size. Then, the ceramic laminate 5 is prepared by degreasing and firing. Subsequently, the external electrodes 6 are formed by Ni plating (base) and Au plating on the conductive patterns defining the external electrodes 6 to complete the chip inductor 1. The plating may be performed with Ni (base) and Sn instead of Ni (base) and Au. The pressure during the press-bonding of the sheet laminate 11 ranges from about 93 MPa to about 120 MPa (from about 1.0 $t/cm^2$ to about 1.2 $t/cm^2$).

In this manufacturing process, after connecting the conductive patterns for the external electrodes 6 to the coil conductor 4 through the via-holes 3, the conductive patterns for the external electrodes 6 are fired in a process for firing the ceramic laminate 5. Therefore, in order to form the external electrodes 6, the coating and firing processes for the conductive paste alone are not required.

In a laminated coil component according to the first preferred embodiment, the chip inductor 1 is preferably provided with one coil conductor 4 inside the ceramic laminate 5. However, the laminated coil component according to the present invention is not limited to the above-mentioned chip inductor 1. Particularly, a plurality of coil conductors 4 may be aligned in parallel inside the ceramic laminate 5. The chip inductor having such a structure is preferably used as a transformer or a common mode choke coil. Furthermore, the present invention can be applied to other laminated coil components, such as a multilayer capacitor, inductor, and a multilayer LC filter.

Second Preferred Embodiment

Figure 9:
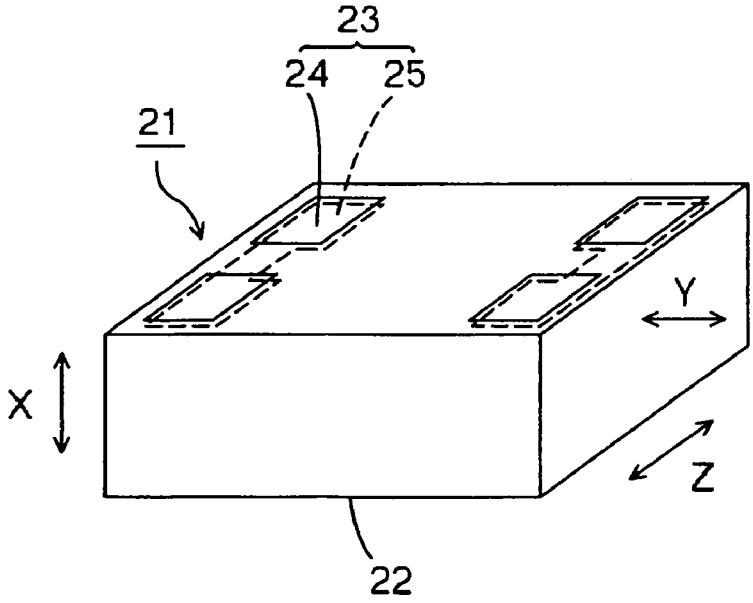
FIG. 9 is a perspective view of an appearance of a chip inductor of a laminated coil component according to a second preferred embodiment of the present invention.
Figure 10:
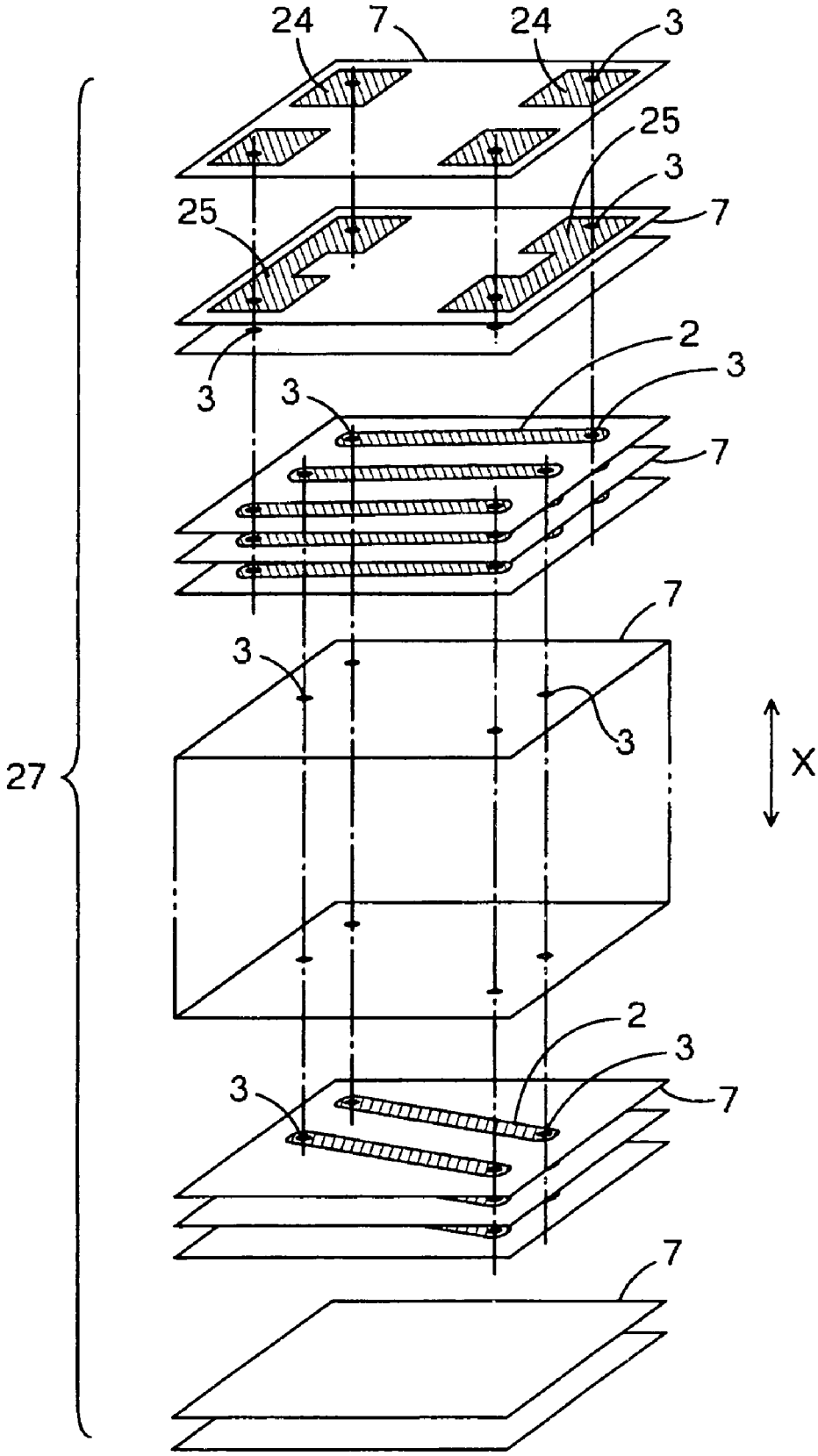
FIG. 10 is an exploded perspective view of the chip inductor.
Figure 11:
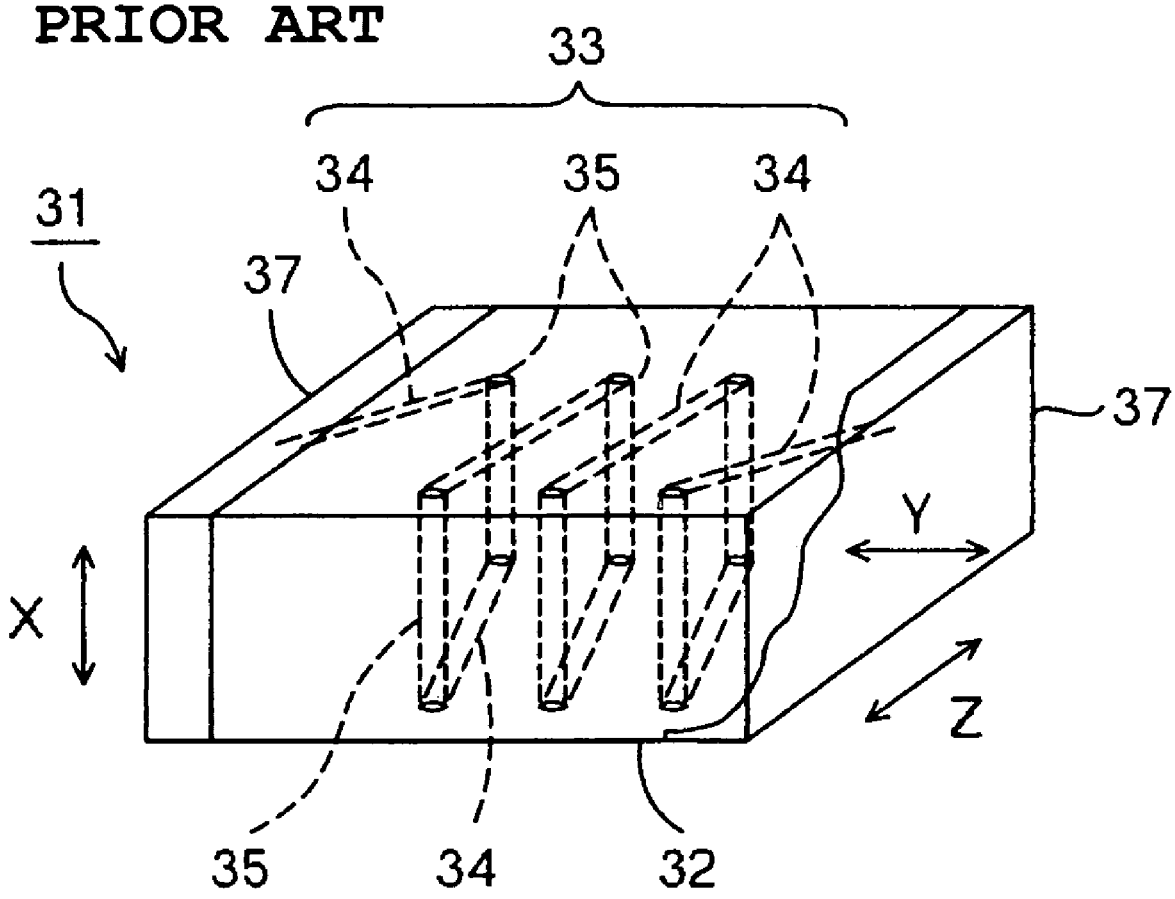
Fig.11 PRIOR ART
FIG. 11 is a perspective view of an appearance of a chip inductor of a laminated coil component according to a known example.

FIG. 9 is a perspective view of an appearance of a chip inductor according to a second preferred embodiment of the present invention. FIG. 10 is an exploded perspective view of the chip inductor. The chip inductor is represented by reference numeral 21. The structure of the chip inductor 21 according to this preferred embodiment is preferably substantially the same as that of the chip inductor 1 according to the first preferred embodiment except for the structure of the external electrodes.

Therefore, in FIGS. 9 and 10, the same elements as those described with reference to FIGS. 1 and 2 are referred to with the same reference numerals as in FIGS. 1 and 2, and the detailed description of these elements is omitted. Since the manufacturing process and the function of the chip inductor 21 according to the second preferred embodiment are substantially the same as those of the chip inductor 1 according to the first preferred embodiment, the detailed description thereof is omitted here.

The chip inductor 21 has an appearance and exploded structure that are similar those of the chip inductor 1, as shown in FIGS. 9 and 10. More specifically, the chip inductor 21 includes a coil conductor 4 including a plurality of strip electrodes 2 and a large number of via-holes 3 inside an approximately rectangular ceramic laminate 22. The via-holes 3 electrically and mechanically connect predetermined ends of the strip electrodes 2. The axis of the coil conductor 4 corresponds with the width direction Z of the ceramic laminate 22 that is substantially perpendicular to both the laminated direction (thickness direction) X of the ceramic laminate 22 and the longitudinal direction Y of the ceramic laminate 22.

One of the ends of each strip electrodes 2 aligned at the outermost locations in the width direction Z at the upper position of the ceramic laminate 22 is connected to the via-hole 3 passing through the ceramic laminate 22 in the thickness direction X and extending to the upper main surface in the thickness direction X of the ceramic laminate 22. External electrodes 23 are disposed at the side portions in the longitudinal direction Y of the upper main surface in the thickness direction X of the ceramic laminate 22.

Each of the external electrodes 23 includes a pair of top electrodes 24 that are spaced apart from each other and a bottom electrode 25 disposed directly below the top electrodes 24. The top electrodes 24 and the bottom electrode 25 are connected through the via-holes 3. The external electrodes 23 are disposed on the top surface in the laminated direction X of the ceramic laminate 22 to cover the regions where the via-holes 3 are aligned.

A method for manufacturing the chip inductor 21 will now be described with reference to FIG. 10. Ceramic green sheets 7 are formed first. Then, through-holes for the via-holes 3 are formed at predetermined positions of a predetermined number of the ceramic green sheets 7. Subsequently, the through-holes are filled with an Ag paste by screen-printing to form via-holes 3. Strip electrodes 2 defining portions of a coil conductor 4 are formed at predetermined locations on each surface of the ceramic green sheets 7 by screen-printing an Ag paste.

Conductive patterns defining the top electrodes 24 and the bottom electrodes 25 of the external electrodes 23 are formed at predetermined locations on the surfaces of other ceramic green sheets 7. A predetermined number of the ceramic green sheets 7 having only the via-holes 3 are stacked in the laminated direction X. Then, a predetermined number of the ceramic green sheets 7 having both the strip electrodes 2 and the via-holes 3 are stacked on the top and the bottom of the resulting laminate of ceramic green sheets 7.

Furthermore, the ceramic green sheet 7 having the conductive patterns defining the bottom electrodes 25 of the external electrodes 23 is stacked on the top of the resulting laminate of ceramic green sheets 7. Then, the ceramic green sheet 7 having the conductive patterns defining the top electrodes 24 of the external electrodes 23 is stacked on the top of the resulting laminate of ceramic green sheets 7. On the other hand, on the bottom of the resulting laminate of ceramic green sheets 7, the ceramic green sheets 7 without any of the strip electrodes 2, the via-holes 3, and the conductive patterns for the top electrodes 24 and the bottom electrodes 25 of the external electrodes 6 are stacked.

A sheet laminate 27 formed in such a process is press-bonded along the laminated direction X, and is then cut to have a predetermined size. Then, the ceramic laminate 22 is prepared by degreasing and firing. Subsequently, the external electrodes 23 are formed by plating the conductive patterns defining the top electrode 24 of the external electrodes 23 with Ni (base) and Au to complete the chip inductor 21 having an appearance shown in FIG. 9. Since the Au-plated region of the chip inductor 21 having such a structure is narrower than that of the chip inductor 1 according to the first preferred embodiment, manufacturing costs are reduced.

The laminated coil component is not limited to a chip inductor. A laminated coil component having two or more coil conductors arranged in parallel inside a ceramic laminate may be used in a transformer and a common-mode choke coil. Furthermore, the present invention can be applied to other laminated coil components such as multilayer capacitors, inductors, and multilayer LC filters.

While the present invention has been described with respect to preferred embodiments, it will be apparent to those skilled in the art that the disclosed invention may be modified in numerous ways and may assume many embodiments other than those specifically set out and described above. Accordingly, it is intended by the appended claims to cover all modifications of the present invention that fall within the true spirit and scope of the invention.

The invention claimed is:

1. A laminated coil component comprising:

a coil conductor including a plurality of strip electrodes and via-holes for connecting predetermined ends of the strip electrodes inside a ceramic laminate;

wherein an axis of the coil conductor corresponds with a width direction of the ceramic laminate, which is substantially perpendicular to both a thickness direction and a length direction of the ceramic laminate, wherein the laminated coil component further comprises external electrodes disposed at end regions in the length direction on a main surface in the lamination direction of the ceramic laminate and connected to the ends of the coil conductor.

2. The laminated coil component according to claim 1, wherein the external electrodes cover regions where the via-holes are arranged.

3. The laminated coil component according to claim 1, wherein the external electrodes are spaced from edges of the main surface of the ceramic laminate.

4. The laminated coil component according to claim 1, wherein the via-holes are filled with a conductive material.

5. The laminated coil component according to claim 4, wherein the conductive material is Ag paste.

6. The laminated coil component according to claim 1, wherein the external electrodes include a Ni base layer and an Au layer disposed on the Ni base layer.

7. The laminated coil component according to claim 1, wherein the external electrodes include a Ni base layer and a Sn layer disposed on the Ni base layer.

8. The laminated coil component according to claim 1, wherein the external electrodes include a pair of top electrodes spaced apart from one another on a main surface of the ceramic laminate and a bottom electrode disposed directly below the top electrodes in the ceramic laminate.

9. The laminated coil component according to claim 1, wherein coil conductor is spiral-shaped.

* * * * *